US012338632B2

(12) United States Patent
Boss et al.

(10) Patent No.: US 12,338,632 B2
(45) Date of Patent: Jun. 24, 2025

(54) ROOFING STRUCTURES AND RELATED METHODS

(71) Applicant: BMIC LLC, Dallas, TX (US)

(72) Inventors: Daniel E. Boss, Morris Township, NJ (US); Li-Ying Yang, Whippany, NJ (US); Eric R. Anderson, Montclair, NJ (US); David Scott, Grove City, OH (US)

(73) Assignee: BMIC LLC, Dallas, TX (US)

( * ) Notice: Subject to any disclaimer, the term of this patent is extended or adjusted under 35 U.S.C. 154(b) by 245 days.

(21) Appl. No.: 18/093,952

(22) Filed: Jan. 6, 2023

(65) Prior Publication Data

US 2023/0220675 A1 Jul. 13, 2023

Related U.S. Application Data

(60) Provisional application No. 63/297,443, filed on Jan. 7, 2022.

(51) Int. Cl.

| | |
|---|---|
| ***E04D 13/15*** | (2006.01) |
| ***E04D 3/36*** | (2006.01) |
| ***E04D 5/00*** | (2006.01) |
| *E04D 3/366* | (2006.01) |

(52) U.S. Cl.

CPC ..... *E04D 13/15* (2013.01); *E04D 5/00* (2013.01); *E04D 3/366* (2013.01)

(58) Field of Classification Search

CPC ..... E04D 5/142; E04D 5/146; E04D 3/15; E04D 3/366; E04D 3/08; E04D 3/362; E04D 3/365; E04D 3/38; E04D 2003/0806; E04D 5/00; E04D 1/29; E04D 1/2914; E04D 1/2916; E04D 1/2918;

(Continued)

(56) References Cited

U.S. PATENT DOCUMENTS

| | | | | |
|---|---|---|---|---|
| 220,181 A | | 9/1879 | Slaughter | |
| 259,228 A | * | 6/1882 | Kane | E04F 13/0864 52/459 |
| 550,325 A | | 11/1895 | Kinnear | |

(Continued)

FOREIGN PATENT DOCUMENTS

CN 108149849 A 6/2018

OTHER PUBLICATIONS

S&T Metals; https://www.stmetals.net/commerical-metal-roofing/custom-metal-roofing/; Custom Metal Roofing; Custom Metal Roofing Made right on the Job-site by S&T Metals; dated Dec. 30, 2019.

(Continued)

*Primary Examiner* — Kyle J. Walraed-Sullivan

(74) *Attorney, Agent, or Firm* — GREENBERG TRAURIG, LLP

(57) ABSTRACT

Some embodiments relate to a roofing structure. The roofing structure comprises a plurality of roofing membranes positioned on a roofing substrate. Each of the plurality of roofing membranes comprises an edge portion that abuts or overlaps with, or is adjacent to, an edge portion of another roofing membrane, so as to define a plurality of seams between adjacent roofing membranes. The roofing structure further comprises a plurality of standing seam structures positioned over the plurality of seams so as to conceal the plurality of seams.

24 Claims, 5 Drawing Sheets

(58) Field of Classification Search
CPC ..... E04D 1/2963; E04D 5/141; E04D 5/143; E04D 5/144; E04D 13/15; E04D 13/155
See application file for complete search history.

(56) References Cited

U.S. PATENT DOCUMENTS 993,686 A * 5/1911 Howard ..... E04F 13/04 52/417
2,160,845 A * 6/1939 Eason ..... E04D 5/142 52/545
2,234,799 A * 3/1941 Eason ..... E04D 3/40 52/459
2,241,058 A * 5/1941 Eason ..... E04D 5/142 52/545
3,111,787 A 11/1963 Chamberlain
3,760,546 A 9/1973 Martin et al.
4,135,342 A 1/1979 Cotter
4,192,116 A * 3/1980 Kelly ..... E04D 5/142 428/161
4,439,969 A 4/1984 Bartlett
4,668,315 A 5/1987 Brady et al.
RE32,710 E * 7/1988 Seaman ..... E04D 5/149 52/522
5,295,338 A 3/1994 Guffey et al.
5,535,567 A 7/1996 Cahoon
5,572,843 A * 11/1996 Jordan ..... E04D 5/142 52/410
6,230,461 B1 5/2001 Piront
6,272,807 B1 8/2001 Waldrop
6,730,841 B2 5/2004 Heckeroth
7,690,169 B2 4/2010 Saarenko et al.
7,712,278 B2 5/2010 Lonardi
7,861,478 B2 1/2011 Kalkanoglu et al.
7,900,414 B2 3/2011 Seccombe
8,028,475 B2 10/2011 Sigmund et al.
8,171,689 B2 5/2012 Pierson et al.
8,230,656 B2 7/2012 Kalkanoglu et al.
8,316,603 B2 11/2012 Flynn et al.
8,438,800 B2 5/2013 McLain et al.
8,438,801 B2 5/2013 McLain et al.
8,561,364 B2 10/2013 Pendley et al.
8,806,827 B2 8/2014 Perttula et al.
8,834,993 B2 9/2014 Yang
8,863,442 B2 10/2014 Freeman
9,003,733 B1 4/2015 Simpson et al.
9,027,291 B2 5/2015 Pendley et al.
9,097,019 B1 8/2015 Rasmussen et al.
9,127,461 B2 9/2015 Pendley et al.
9,181,702 B2 11/2015 Rasmussen et al.
9,181,703 B2 11/2015 Rasmussen et al.
9,181,704 B2 11/2015 Rasmussen et al.
9,206,606 B2 12/2015 Jaks
9,212,488 B1 12/2015 McGraw et al.
9,334,652 B2 5/2016 Plath et al.
9,404,262 B1 8/2016 Smith, Jr.
9,493,955 B1 11/2016 Christian
9,574,351 B2 2/2017 Karr et al.
9,637,927 B2 5/2017 Pendley et al.
9,677,279 B2 6/2017 Pendley et al.
9,689,164 B2 6/2017 Rasmussen et al.
9,708,814 B2 7/2017 Vander Laan et al.
9,963,880 B2 5/2018 Kraus et al.
10,316,519 B2 6/2019 Bogh et al.
10,422,138 B1 9/2019 French et al.
10,465,384 B2 11/2019 Bogh et al.
10,742,159 B2 8/2020 Sabban
10,808,403 B2 10/2020 Bodwell et al.
10,866,012 B2 12/2020 Kvasnicka et al.
10,876,304 B2 12/2020 Shaw
10,920,429 B2 2/2021 Shaw
10,968,634 B2 4/2021 Bolo
11,236,510 B2 2/2022 Stephan et al.
11,447,954 B2 9/2022 McDonald
2006/0032176 A1* 2/2006 Pierson ..... E04D 3/366 52/588.1
2006/0096211 A1* 5/2006 Verheyen ..... E04D 3/3608 52/408
2010/0146898 A1* 6/2010 Pierson ..... E04D 3/365 52/549
2010/0287849 A1* 11/2010 Covone ..... E04D 13/15 52/741.3
2013/0186028 A1 7/2013 Resso et al.
2014/0086680 A1* 3/2014 Header ..... F24S 25/615 403/374.3
2014/0215963 A1 8/2014 Bradenburg et al.
2016/0123013 A1 5/2016 Rasmussen et al.
2018/0347196 A1* 12/2018 Stearns ..... E04D 1/30
2021/0095467 A1 4/2021 Zheng et al.
2021/0156150 A1 5/2021 Boss et al.
2021/0222432 A1 7/2021 Anderson et al.
2021/0285218 A1 9/2021 Lowe
2021/0301534 A1 9/2021 Svec et al.
2021/0317661 A1 10/2021 Svec et al.
2021/0317662 A1 10/2021 Svec et al.
2022/0064955 A1 3/2022 Nelson, Jr.
2022/0195733 A1* 6/2022 Nash ..... E04D 12/004

OTHER PUBLICATIONS

JMAR Roofing & Sheet Metal; On-Site Roof Panel Manufacturing a Plus; available before Dec. 30, 2019.

Cost Comparison Helper; http://costcomparisonhelper.com/compare-prices/roofing/steel-roofing.html; Compare Average Cost of Steel Roofing InstallationISteel Roofing Price Quotes; ; pp. 1-4; available as of Nov. 20, 2014.

AMR-Advantage Metal Roofs; http://www.advantagementalroofs.com/country_manor_shake.html; Austin Texas Metal Roofing Professionals—Advantage Metal Roofs; pp. 1-2; available as of Nov. 20, 2014.

* cited by examiner

ROOFING STRUCTURES AND RELATED METHODS

CROSS-REFERENCE

The present Patent Application claims the benefit of U.S. Provisional Patent Application No. 63/297,443, filed Jan. 7, 2022.

INCORPORATION BY REFERENCE

The disclosure of the U.S. Provisional Patent Application No. 63/297,443, filed Jan. 7, 2022, is specifically incorporated by reference herein as if set forth in its entirety.

FIELD

This disclosure generally relates to roofing structures for roofing applications and related methods.

BACKGROUND

Installation of roofing structures is a labor-intensive and time-intensive process. Accordingly, roofing structures can be expensive to install. The tasks involved in the installation of the roofing structures can tedious and complicated.

SUMMARY

Briefly described, present disclosure relates to roofing structures and methods of forming roofing structures. In embodiments, the roofing structures of the present disclosure can be used to form sloped roofs, including steep sloped roofs, as well as low slope roofs. In addition, embodiments of the roofing structure can be used for residential roofs, as well as for commercial roofing applications.

In embodiments, the roofing structure includes a plurality of roofing membranes that can be positioned along a roofing substrate, for example, along a deck of a roof. The roofing membranes can comprise a flexible polymer material that can be applied to the roofing substrate in sheets, or can be rolled out over the roofing substrate, and will include a plurality of peripheral edge portions. For example, in embodiments, the roofing membranes can comprise a sheet having a first edge portion and a second edge portion that can define opposite side edges of the roofing membranes when installed on the roofing substrate. In some embodiments, the roofing membranes can comprise a single layer of a weather resistant material (e.g., a material configured to withstand exposure to weather, such as wind, rain, snow, extreme heat, extreme cold, ultraviolet (UV) light, etc.); while, in other embodiments, the roofing membranes can comprise a multilayer structure, including at least a first layer and a second layer with at least one layer having an upper surface exposed to weather. In addition, in embodiments, the roofing membranes can be provided with aesthetic characteristics or visual features, such as be formed with a selected color, or having a selected pattern along the exposed upper surface thereof.

In embodiments, a method of forming a roofing structure can include installing at least a first roofing membrane of the plurality of roofing membranes along a roofing substrate, for example, being rolled out or laid on top of the roofing substrate. A second roofing membrane then will be positioned on top of the roofing substrate adjacent the first roofing membrane. In embodiments, an edge portion of the second roofing membrane can be positioned in abutment with an adjacent edge portion of the first roofing membrane (e.g., with the edge portions of the first and second roofing membranes contacting, or, in embodiments, being adjacent each other but not in direct contact), and in some embodiments, the edge portion of the second roofing membrane can be in overlapping contact with the adjacent edge portion of the first roofing membrane, so as to form a seam between the first and second roofing membranes. In some embodiments, the edge portions of the first and second roofing membranes can be sealed along the seam defined therebetween, such as by a sealant or thermal bond. In addition, in embodiments, a plurality of standing seam structures can be provided, with one or more of the standing seam structures positioned over the seam between the first and second roofing membranes. In some embodiments, the standing seam structures will be configured to substantially cover the seam between the first and second roofing membranes sufficient to conceal the seam. The standing seam structures further can be configured to provide additional aesthetic characteristics or visual features to the roofing structure upon installation.

In addition, in some embodiments, a third roofing membrane can be positioned on the roofing substrate adjacent the second roofing membrane. For example, the third roofing membrane can be positioned along the roofing substrate along an opposite side of the second roofing membrane from the first roofing membrane. The third roofing membrane can be positioned adjacent the second roofing membrane, with an edge portion thereof abutting or in overlapping contact with an adjacent edge portion of the second roofing membrane so as to define a seam between the second and third roofing membranes. In embodiments, one or more standing seam structures also can be positioned over the seam defined between the second and third roofing membranes, substantially covering and concealing the seam between the second and third roofing membranes. The process of installing the plurality of roofing membranes on the roofing substrate further can continue across the width of the roofing substrate with the application of additional roofing membranes to form the completed roofing structure.

In one aspect, the present disclosure relates to a roofing structure comprising, of at least one of a roofing substrate, a plurality of roofing membranes, a plurality of standing seam structures, or any combination thereof. In some embodiments, each of the plurality of roofing membranes comprises a non-edge portion, a first edge portion, and a second edge portion opposite the first edge portion. In some embodiments, the first edge portion comprises or is selected from the group consisting of at least one of a selvage edge, an offset edge, an abutting edge, or any combination thereof. In some embodiments, the second edge portion comprises or is selected from the group consisting of at least one of a selvage edge, an offset edge, an abutting edge, or any combination thereof. In some embodiments, the edge portions of the plurality of roofing membranes overlap each other so as to define a plurality of seams. In some embodiments, the edge portions of the plurality of roofing membranes are adjacent to each other so as to define a plurality of seams. In some embodiments, the plurality of standing seam structures is positioned over the plurality of seams so as to conceal the plurality of seams. In some embodiments, patterns on the plurality of roofing membranes are configured to be aligned on the roofing substrate sufficient to result in a continuous pattern which conceals the seam.

In another aspect, a roofing structure is provided, comprising a plurality of roofing membranes on a roofing substrate. In some embodiments, the plurality of roofing membranes comprises a first roofing membrane. In some embodiments, the first roofing membrane comprises a first edge portion, and a second edge portion opposite the first edge portion. In some embodiments, the first edge portion and the second edge portion of the first roofing membrane comprise at least one of a selvage edge, an offset edge, or any combination thereof. In some embodiments, the plurality of roofing membranes comprises a second roofing membrane. In some embodiments, the second roofing membrane comprises a first edge portion, and a second edge portion opposite the first edge portion. In some embodiments, the first edge portion and the second edge portion of the second roofing membrane comprise at least one of a selvage edge, an offset edge, or any combination thereof. In some embodiments, the first edge portion of the second roofing membrane overlaps the first edge portion of the first roofing membrane so as to define a first seam. In some embodiments, the plurality of roofing membranes comprises a third roofing membrane. In some embodiments, the third roofing membrane comprises a first edge portion, and a second edge portion opposite the first edge portion. In some embodiments, the first edge portion and the second edge portion of the third roofing membrane comprise at least one of a selvage edge, an offset edge, or any combination thereof. In some embodiments, the second edge portion of the third roofing membrane overlaps the second edge portion of the second roofing membrane so as to define a second seam. In some embodiments, the roofing structure comprises a plurality of standing seam structures. In some embodiments, the plurality of standing seam structures comprises a first standing seam structure. In some embodiments, the first standing seam structure is positioned over the first seam so as to conceal the first seam. In some embodiments, the plurality of standing seam structures comprises a second standing seam structure. In some embodiments, the second standing seam structure is positioned over the second seam so as to conceal the second seam.

In embodiments, the roofing structure comprises a steep slope roof, wherein the roofing substrate comprises a pitch of Y/X, Y and X are in a ratio of 4:12 to 12:12; and in some embodiments, the roofing structure comprises a low slope roof, wherein the roofing substrate can comprise a pitch in a ratio of 1:12 to 3:12.

In some embodiments, the first edge portion of the first roofing membrane is a selvage edge. In some embodiments, the first edge portion of the second roofing membrane is a selvage edge. In some embodiments, the second edge portion of the second roofing membrane is a selvage edge. In some embodiments, the second edge portion of the third roofing membrane is a selvage edge.

In some embodiments, the first edge portion of the first roofing membrane is an offset edge. In some embodiments, the first edge portion of the second roofing membrane is an offset edge. In some embodiments, the second edge portion of the second roofing membrane is an offset edge. In some embodiments, the second edge portion of the third roofing membrane is an offset edge.

In some embodiments, the first standing seam structure is substantially parallel to the second standing seam structure.

In some embodiments, the roofing structure further comprises a third standing seam structure. In some embodiments, the third standing seam structure is positioned over a non-edge portion of at least one of the first roofing membrane, the second roofing membrane, or the third roofing membrane.

In some embodiments, the third standing seam structure is substantially parallel to at least one of the first standing seam structure, the second standing seam structure, or any combination thereof.

In some embodiments, at least one of the first standing seam structure, the second standing seam structure, or any combination thereof comprises an inverted T-shaped standing seam structure.

In some embodiments, at least one of the first standing seam structure, the second standing seam structure, or any combination thereof comprises an L-shaped standing seam structure.

In some embodiments, a recessed cavity is formed in a bottom surface of at least one of the first standing seam structure, the second standing seam structure, or any combination thereof.

In some embodiments, the first edge portions and the second edge portions of the first roofing membrane, the second roofing membrane, and the third roofing membrane do not comprise abutting edges.

In some embodiments, the plurality of standing seam structures does not have a surface in direct contact with a surface of the roofing substrate.

In some embodiments, the plurality of roofing membranes does not have any surface overlying a surface of the plurality of standing seam structures.

In some embodiments, the plurality of roofing membranes does not comprise a metal.

According to another aspect of the present disclosure, a method comprises obtaining a plurality of roofing membranes, wherein, in some embodiments, the plurality of roofing membranes comprises a first roofing membrane. In some embodiments, the first roofing membrane comprises a first edge portion, and a second edge portion opposite the first edge portion. In some embodiments, the first edge portion and the second edge portion of the first roofing membrane comprises at least one of a selvage edge, an offset edge, or any combination thereof. In some embodiments, the plurality of roofing membranes comprises a second roofing membrane. In some embodiments, the second roofing membrane comprises a first edge portion, and a second edge portion opposite the first edge portion. In some embodiments, the first edge portion and the second edge portion of the second roofing membrane comprises at least one of a selvage edge, an offset edge, or any combination thereof. In some embodiments, the plurality of roofing membranes comprises a third roofing membrane. In some embodiments, the third roofing membrane comprises a first edge portion, and a second edge portion opposite the first edge portion. In some embodiments, the first edge portion and the second edge portion of the third roofing membrane comprises at least one of a selvage edge, an offset edge, or any combination thereof. In some embodiments, the method further comprises obtaining a plurality of standing seam structures. In some embodiments, the plurality of standing seam structures comprises a first standing seam structure and a second standing seam structure. In some embodiments, the method comprises applying the first roofing membrane to a roofing substrate such that the first roofing membrane covers at least a portion of the roofing substrate. In embodiments, the method further comprises applying the second roofing membrane to the roofing substrate such that the first edge portion of the second roofing membrane overlaps the first edge portion of the first roofing membrane so as to define a first seam; and applying the third roofing membrane to the roofing substrate such that the second edge portion of the third roofing membrane overlaps the second edge portion of the second roofing membrane so as to define a second seam. In addition, in some embodiments, the method comprises applying the first standing seam structure to the first seam so as to conceal the first seam, and in some embodiments, applying the second standing seam structure to the second seam so as to conceal the second seam.

In some embodiments, the roofing structure comprises a steep slope roof, wherein the roofing substrate comprises a pitch of Y/X, Y and X are in a ratio of 4:12 to 12:12, and in some embodiments, the roofing structure comprises a low slope roof, wherein the roofing substrate can comprise a pitch in a ratio of 1:12 to 3:12.

In some embodiments, the first edge portion of the first roofing membrane is a selvage edge. In some embodiments, the first edge portion of the second roofing membrane is a selvage edge. In some embodiments, the second edge portion of the second roofing membrane is a selvage edge. In some embodiments, the second edge portion of the third roofing membrane is a selvage edge.

In some embodiments, the first edge portion of the first roofing membrane is an offset edge. In some embodiments, the first edge portion of the second roofing membrane is an offset edge. In some embodiments, the second edge portion of the second roofing membrane is an offset edge. In some embodiments, the second edge portion of the third roofing membrane is an offset edge.

In some embodiments, the first standing seam structure is substantially parallel to the second standing seam structure.

In some embodiments, the method further comprises obtaining a third standing seam structure; and applying the third standing seam structure to a non-edge portion of at least one of the first roofing membrane, the second roofing membrane, the third roofing membrane, or any combination thereof.

In some embodiments, the third standing seam structure is substantially parallel to at least one of the first standing seam structure, the second standing seam structure, or any combination thereof.

In some embodiments, at least one of the first standing seam structure, the second standing seam structure, or any combination thereof comprises an inverted T-shaped standing seam structure.

In some embodiments, at least one of the first standing seam structure, the second standing seam structure, or any combination thereof comprises an L-shaped standing seam structure.

In some embodiments, a recessed cavity is formed in a bottom surface of at least one of the first standing seam structure, the second standing seam structure, or any combination thereof.

In some embodiments, the first edge portions and the second edge portions of the first roofing membrane, the second roofing membrane, and the third roofing membrane do not comprise abutting edges.

In some embodiments, the plurality of standing seam structures does not have a surface in direct contact with a surface of the roofing substrate.

In some embodiments, the plurality of roofing membranes does not have any surface overlying a surface of the plurality of standing seam structures.

In some embodiments, the plurality of roofing membranes does not comprise a metal.

According to another aspect of the present disclosure, a roofing structure comprises a roofing substrate; a plurality of roofing membranes positioned along the roofing substrate, the plurality of roofing membranes comprising a first roofing membrane having a first edge portion and a second edge portion opposite the first edge portion; and a second roofing membrane comprising a first edge portion, and a second edge portion opposite the first edge portion; and wherein the first edge portion of the second roofing membrane is configured to abut or overlap the first edge portion of the first roofing membrane so as to define a first seam between the first roofing membrane and the second roofing membrane; a plurality standing seam structures positioned over the first seam, each of the plurality of standing seam structures having a vertical member, and a horizontal member extending substantially perpendicular to the vertical member and configured to substantially conceal the first seam.

In embodiments of the roofing structure, the substrate comprises a pitch of 4:12 to 12:12.

In embodiments, the roofing structure further comprises a third roofing membrane having a first edge portion, and a second edge portion opposite the first edge portion; wherein the second edge portion of the third roofing membrane is configured to abut or overlap the second edge portion of the second roofing membrane so as to define a second seam between the second roofing membrane and the third roofing membrane.

In embodiments of the roofing structure, at least one of the first edge portion of the first roofing membrane, the first edge portion of the second roofing membrane, the second edge portion of the second roofing membrane, or the second edge portion of the third roofing membrane comprises a selvage edge, an offset edge, or a combination thereof.

In embodiments, the roofing structure further comprises a third roofing membrane having a first edge portion, and a second edge portion opposite the first edge portion and configured to overlap the second edge portion of the second roofing membrane so as to define a second seam between the second roofing membrane and the third roofing membrane; and wherein the plurality of standing seam structures comprises a first standing seam structure positioned over the first seam, a second standing seam structure positioned over the second seam, and a third standing seam structure positioned over a non-edge portion of at least one of the first roofing membrane, the second roofing membrane, or the third roofing membrane.

In embodiments of the roofing structure, the third standing seam structure is positioned substantially parallel to at least one of the first standing seam structure, the second standing seam structure, or both the first standing seam structure and the second standing seam structure.

In embodiments of the roofing structure, the plurality of roofing membranes comprises single layer membranes, multi-layer membranes, or a combination thereof.

In embodiments of the roofing structure, one or more of the standing seam structures of the plurality of the standing seam structures comprises an inverted T-shaped standing seam structure.

In embodiments of the roofing structure, one or more of the standing seam structures of the plurality of the standing seam structures comprises an L-shaped standing seam structure.

In embodiments of the roofing structure, the horizontal member of at least some of the plurality of standing seam structures further comprises a recessed cavity formed in a bottom surface thereof; wherein the recessed cavity is configured to receive at least a portion of abutting or overlapped first edge portions of the first standing roofing membrane and, the second standing roofing membrane.

According to another aspect of the present disclosure, a method, comprises obtaining a plurality of roofing membranes, each of the roofing membranes comprising a first edge portion and a second edge portion opposite the first edge portion; wherein the first edge portion and the second edge portion of the roofing membranes comprise at least one of a selvage edge, an offset edge, or a combination thereof; positioning a first roofing membrane on a roofing substrate; positioning a second roofing membrane on the roofing substrate adjacent the first roofing membrane, with the first edge portion of the second roofing membrane abutting or in overlapped contact with the first edge portion of the first roofing membrane so as to define a seam therebetween; and positioning at least one standing seam structure over the seam defined between the first and second roofing membranes; wherein the at least one standing seam structure is configured to substantially cover and conceal the seam.

In an embodiment, the method further comprises positioning a third roofing membrane on the roofing substrate adjacent the second roofing membrane, with the second edge portion of the third roofing membrane abutting or in overlapping contact with the second edge portion of the second roofing membrane so as to define a second seam between the second roofing membrane and the third roofing membrane.

In an embodiment, the method further comprises positioning a second standing seam structure to the second seam so as to conceal the second seam.

In an embodiment, the method further comprises positioning a third standing seam structure along a non-edge portion of at least one of the first roofing membrane, the second roofing membrane, the third roofing membrane, or any combination thereof.

In an embodiment of the method, positioning the first roofing membrane and positioning the seconding roofing membrane on the roofing structure comprise applying the first and second roofing membranes across a slope of the substrate, with the at least one standing seam structure extending in a substantially horizontal direction.

In an embodiment of the method positioning the first roofing membrane and positioning the seconding roofing membrane on the roofing structure comprise applying the first and second roofing membranes along a slope of the substrate extending from a ridge to an eave, with the at least one standing seam structure extending in a substantially vertical direction.

According to still another aspect of the present disclosure, a roofing structure comprises a roofing substrate; a plurality of roofing membranes positioned on the roofing substrate, each of the roofing membranes comprising a sheet formed from a weather resistant material and having a first edge portion and a second edge portion; and wherein a first edge portion of a first roofing membrane is positioned in abutment or in overlapping contact with an adjacent first edge portion of a second roofing membrane so as to define a seam between the first roofing membrane and the second roofing membrane; at least one standing seam structure positioned over the seam between the first roofing membrane and the second roofing membrane, the at least one standing seam structure comprising a vertical member and a horizontal member extending substantially perpendicular to the vertical member; wherein the at least one standing seam structure is configured to seat over the seam between the first roofing membrane and the second roofing membrane sufficient to conceal the seam.

In embodiments of the roofing structure, the plurality of roofing membranes comprises single layer membranes, multi-layer membranes, or a combination thereof.

In embodiments, the roofing structure comprises a third roofing membrane having a first edge portion, and a second edge portion opposite the first edge portion and configured to overlap the second edge portion of the second roofing membrane so as to define a second seam between the second roofing membrane and the third roofing membrane; a second standing seam structure positioned over the second seam, and a third standing seam structure positioned over a non-edge portion of at least one of the first roofing membrane, the second roofing membrane, or the third roofing membrane.

In embodiments of the roofing structure, the at least one standing seam structure comprises an inverted T-shaped standing seam structure.

In embodiments of the roofing structure, the at least one standing seam structure comprises an inverted L-shaped standing seam structure.

In embodiments of the roofing structure, the horizontal member of the at least one standing seam structure further comprises a recessed cavity formed in a bottom surface thereof; wherein the recessed cavity is configured to receive at least a portion of abutting or overlapped first edge portions of the first standing roofing membrane and, the second standing roofing membrane.

In embodiments of the roofing structure, the roofing substrate comprises at least one of a plywood substrate, a glass substrate, a cellulosic substrate, a polymeric substrate, a shingle, a scrim, a fabric, a glass mat, a fiberglass mat, an asphalt-coated fiberglass mat, an underlayment, a roofing membrane, a roof deck, a photovoltaic (PV) panel, a modified bitumen (MODBIT) material, a polyisocyanurate (ISO) foam board, a cover board, a gypsum board, metal panel, a concrete slab, a chimney, an asphalt material, or a combination thereof.

In embodiments of the roofing structure, the roofing membranes comprise at least one of a thermoplastic polyolefin (TPO), a polyvinyl chloride (PVC), an ethylene propylene diene monomer rubber (EPDM), poly(styrene-butadiene-styrene) (SBS), atactic polypropylene (APP), or a combination thereof.

Accordingly, embodiments of roofing structures and methods of installing roofing structures are disclosed herein. The foregoing and other advantages and aspects of the embodiments of the present disclosure will become apparent and more readily appreciated from the following detailed description and the claims, taken in conjunction with the accompanying drawings. Moreover, it is to be understood that both the foregoing information and the following detailed description provide merely illustrative examples of various aspects and embodiments, and are intended to provide an overview or framework for understanding the nature and character of the claimed aspects and embodiments.

BRIEF DESCRIPTION OF THE DRAWINGS

Reference is made to the drawings that form a part of this disclosure, and which illustrate embodiments in which the materials and methods described herein can be practiced. The accompanying drawings, which are included to provide a further understanding of the embodiments of the present disclosure, are incorporated in and constitute a part of this specification, illustrate embodiments of this disclosure, and together with the detailed description, serve to explain the principles of the embodiments discussed herein. No attempt is made to show structural details of this disclosure in more detail than may be necessary for a fundamental understanding of the exemplary embodiments discussed herein and the various ways in which they may be practiced.

DETAILED DESCRIPTION

Figure 1:
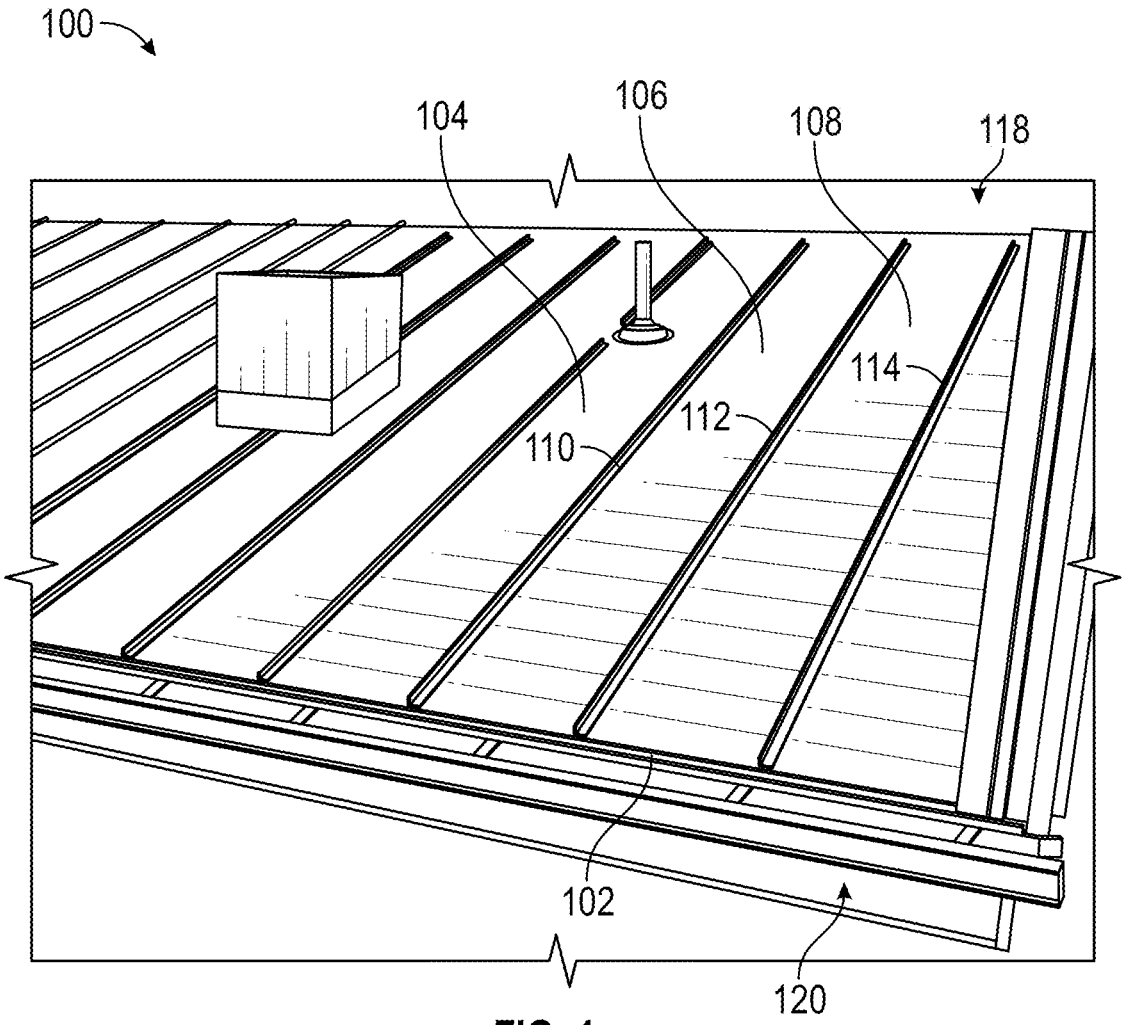
FIG. 1 is a schematic diagram of a roofing structure, according to some embodiments.

The present disclosure is directed to a roofing structure and methods of installing a roof structure. In embodiments, the roofing structure can be used to form a steep slope roof. It will, however, be understood by those skilled in the art that the roofing structure can be used for construction of low slope roofs, and for construction of roofs for commercial and residential construction. Referring now to the figures, FIG. 1 is a schematic diagram of a roofing structure, according to some embodiments of the present disclosure.

In some embodiments, the roofing structure 100 comprises a roofing substrate 102. In some embodiments, the roofing substrate 102 comprises, consists of, or consists essentially of at least one of a plywood substrate, a glass substrate, a cellulosic substrate, a polymeric substrate, a shingle, a scrim, a fabric, a glass mat, a fiberglass mat, an asphalt-coated fiberglass mat, an underlayment, a roofing membrane, a roof deck, a photovoltaic (PV) panel, a modified bitumen (MODBIT) substrate, a roll good, a board (such as but not limited to at least one of a foam board (e.g., a polyisocyanurate (ISO) foam board), a cover board, or any combination thereof), a gypsum board, a pipe, a base sheet, a chimney, a wax paper, or any combination thereof. In some embodiments, the roofing substrate 102 comprises asphalt. In some embodiments, the roofing substrate 102 does not comprise asphalt (e.g., 0% by weight of asphalt based on a total weight of the substrate).

In some embodiments, the structure can be configured to form a steep slope roof, and the roofing substrate 102 can comprise a steep slope roof substrate. As defined herein, a "steep slope roof substrate" is any roofing substrate that is disposed on a roof having a pitch of Y/X, where Y and X are in a ratio of 4:12 to 12:12, where Y corresponds to the "rise" of the roof, and where X corresponds to the "run" of the roof. In some embodiments, Y and X are in a ratio of 5:12 to 12:12. In some embodiments, Y and X are in a ratio of 6:12 to 12:12. In some embodiments, Y and X are in a ratio of 7:12 to 12:12. In some embodiments, Y and X are in a ratio of 8:12 to 12:12. In some embodiments, Y and X are in a ratio of 9:12 to 12:12. In some embodiments, Y and X are in a ratio of 10:12 to 12:12. In some embodiments, Y and X are in a ratio of 11:12 to 12:12.

In some embodiments, Y and X are in a ratio of 4:12 to 11:12. In some embodiments, Y and X are in a ratio of 4:12 to 10:12. In some embodiments, Y and X are in a ratio of 4:12 to 9:12. In some embodiments, Y and X are in a ratio of 4:12 to 8:12. In some embodiments, Y and X are in a ratio of 4:12 to 7:12. In some embodiments, Y and X are in a ratio of 4:12 to 6:12. In some embodiments, Y and X are in a ratio of 4:12 to 5:12. In some embodiments, Y and X are in a ratio of 5:12 to 11:12. In some embodiments, Y and X are in a ratio of 6:12 to 10:12. In some embodiments, Y and X are in a ratio of 7:12 to 9:12.

In other embodiments, the roofing structure can be configured to form a low slope roof, and the roofing substrate 102 can comprise a low slope roof substrate. As defined herein, a "low slope roof substrate" is any roofing substrate that is disposed on a roof having a pitch of Y/X, where Y and X are in a ratio of less 4:12, where Y corresponds to the "rise" of the roof, and where X corresponds to the "run" of the roof. In some embodiments, Y and X are in a ratio of less than 3:12. In some embodiments, Y and X are in a ratio of less than 2:12. In some embodiments, Y and X are in a ratio of less than 1:12. In some embodiments, Y and X are in a ratio of 1:12 to 3:12.

In some embodiments, the roofing structure 100 comprises a plurality of roofing membranes on the roofing substrate 102. In embodiments, the roofing structure 100 comprises a first roofing membrane 104, and a second roofing membrane 106; and in some embodiments can further comprise a third roofing membrane 108 on the roofing substrate 102 and possibly other roofing membranes arranged across the roofing substrate 102. As detailed further below, in some embodiments, each of the first roofing membrane 104, the second roofing membrane 106, and the third roofing membrane 108 comprises a sheet 105 with a plurality of peripheral edge portions, including first edge portion and a second edge portion opposite the first edge portion.

In some embodiments, the first edge portion of each roofing membrane comprises at least one of a selvage edge, an offset edge, an abutting edge, or any combination thereof. In some embodiments, the second edge portion of each roofing membrane comprises at least one of a selvage edge, an offset edge, an abutting edge, or any combination thereof and in other embodiments, the first edge portions and second edge portions of the plurality of roofing membranes do not comprise abutting edges. In some embodiments, the peripheral edge portions of the first roofing membrane 104 and the second roofing membrane 106 can be positioned to abut (e.g., be adjacent to each other, and in embodiments, in edge-to-edge contact with each other), or can be overlapped so as to define a first seam. In some embodiments, edge portions of the second roofing membrane 106 and the third roofing membrane 108 can be positioned to abut or overlap so as to define a third seam. In some embodiments, the plurality of roofing membranes does not have any surface overlying a surface of the plurality of standing seam structures.

In some embodiments, the plurality of roofing membranes comprises a plurality of rolled roofing membranes that can be unrolled and applied to the roofing substrate 102. In some embodiments, the plurality of roofing membranes can comprise single layered membranes or multi-layered membranes.

In some embodiments, the roofing membranes comprise at least one laminated layer, at least one extruded layer, at least one molded layer, or any combination thereof; for example, the plurality of roofing membranes can comprise a cap layer, a core layer, and a scrim between the cap layer and the core layer.

In some embodiments, the roofing membranes comprise at least one of a thermoplastic polyolefin (TPO), a polyvinyl chloride (PVC), an ethylene propylene diene monomer rubber (EPDM), poly(styrene-butadiene-styrene) (SBS), atactic polypropylene (APP), or any combination thereof. In some embodiments, the roofing membranes do not comprise a metal. For example, in some embodiments, the roofing membranes do not comprise copper, aluminum, steel, or any combination thereof. In some embodiments, the plurality of roofing membranes further comprises at least one filler.

In some embodiments, the roofing membranes have a width of 0.25 ft to 12 ft. In some embodiments, the roofing membranes have a width of 0.25 ft to 11 ft. In some embodiments, the roofing membranes have a width of 0.25 ft to 10 ft. In some embodiments, the roofing membranes have a width of 0.25 ft to 9 ft. In some embodiments, the roofing membranes have a width of 0.25 ft to 8 ft. In some embodiments, the roofing membranes have a width of 0.25 ft to 7 ft. In some embodiments, the roofing membranes have a width of 0.25 ft to 6 ft. In some embodiments, the roofing membranes have a width of 0.25 ft to 5 ft. In some embodiments, the roofing membranes have a width of 0.25 ft to 4 ft. In some embodiments, the roofing membranes have a width of 0.25 ft to 3 ft. In some embodiments, the roofing membranes have a width of 0.25 ft to 2 ft. In some embodiments, the roofing membranes have a width of 0.25 ft to 1 ft. In some embodiments, the roofing membranes have a width of 1 ft to 12 ft. In some embodiments, the roofing membranes have a width of 2 ft to 12 ft. In some embodiments, the roofing membranes have a width of 3 ft to 12 ft. In some embodiments, the roofing membranes have a width of 4 ft to 12 ft. In some embodiments, the roofing membranes have a width of 5 ft to 12 ft. In some embodiments, the roofing membranes have a width of 6 ft to 12 ft. In some embodiments, the roofing membranes have a width of 7 ft to 12 ft. In some embodiments, the roofing membranes have a width of 8 ft to 12 ft. In some embodiments, the roofing membranes have a width of 9 ft to 12 ft. In some embodiments, the roofing membranes have a width of 10 ft to 12 ft. In some embodiments, the roofing membranes have a width of 11 ft to 12 ft.

In some embodiments, the roofing membranes can be positioned along the roofing substrate in a substantially vertical arrangement, extending from a ridge or hip of the roof to an eave of the roof. The first, second and third roofing membranes can be positioned in spaced series across the width of the roofing substrate with the seams defined therebetween extending in a substantially vertical direction along the slog of the roofing substrate.

In other embodiments, the roofing membranes can be positioned in a substantially horizontal arrangement extending across the roofing substrate. For example, the first roofing membrane can be positioned across the roofing substrate with the second and third roofing membranes positioned downslope from the first roofing membrane.

In some embodiments, the roofing structure 100 further comprises a plurality of standing seam structures extending along at least a portion of a length of the plurality of roofing membranes. In some embodiments, the standing seam structures can be positioned over the seams defined between the adjacent roofing membranes of the plurality of roofing membranes so as to conceal the seams. As used herein, the terms "conceal," "concealed," and the like, when used with respect to a seam, refers to the seam not being visible, or a portion of the seam not being visible. In some embodiments, the plurality of standing seam structures comprises a first standing seam structure 110 that can be positioned over the first seam so as to conceal the first seam; and a second standing seam structure 112 that can be positioned over the second seam so as to conceal the second seam.

In some embodiments, the roofing structure 100 can further comprise additional standing seam structures applied over seams between additional ones of the roofing membranes installed on the roofing substrate. In embodiments, a third standing seam structure 114 can be positioned over a non-edge portion of at least one of the first roofing membrane 104, the second roofing membrane 106, or the third roofing membrane 108, and in some embodiments, the third standing seam structure 114 can be positioned over a non-seam portion of the roofing structure 100. In some embodiments, the plurality of standing seam structures does not have a surface in direct contact with a surface of the roofing substrate.

In some embodiments, the visibility of a seam depends on a percentage of the seam covered (or not covered) by a standing seam structure. In some embodiments, the seam is concealed when a percentage of the seam is covered by a standing seam structure. For example, in some embodiments, the seam is concealed when at least 50% of the seam is covered by a standing seam structure. In some embodiments, the seam is concealed when at least 55% of the seam is covered by a standing seam structure. In some embodiments, the seam is concealed when at least 60% of the seam is covered by a standing seam structure. In some embodiments, the seam is concealed when at least 65% of the seam is covered by a standing seam structure. In some embodiments, the seam is concealed when at least 70% of the seam is covered by a standing seam structure. In some embodiments, the seam is concealed when at least 75% of the seam is covered by a standing seam structure. In some embodiments, the seam is concealed when at least 80% of the seam is covered by a standing seam structure. In some embodiments, the seam is concealed when at least 85% of the seam is covered by a standing seam structure. In some embodiments, the seam is concealed when at least 90% of the seam is covered by a standing seam structure. In some embodiments, the seam is concealed when at least 95% of the seam is covered by a standing seam structure. In some embodiments, the seam is concealed when at least 100% of the seam is covered by a standing seam structure. In some embodiments, the percentage coverage of a seam by a standing seam structure is determined by calculating the percentage of the seam, based on surface area, not covered by the standing seam structure.

In some embodiments, the visibility of a seam depends on a distance from which the seam is being viewed. For example, in some embodiments, the seam is concealed when the seam is not visible to an observer when viewed from a distance of at least 1 ft. In some embodiments, the seam is concealed when the seam is not visible to an observer when viewed from a distance of at least 2 ft. In some embodiments, the seam is concealed when the seam is not visible to an observer when viewed from a distance of at least 3 ft. In some embodiments, the seam is concealed when the seam is not visible to an observer when viewed from a distance of at least 4 ft. In some embodiments, the seam is concealed when the seam is not visible to an observer when viewed from a distance of at least 5 ft. In some embodiments, the seam is concealed when the seam is not visible to an observer when viewed from a distance of at least 6 ft. In some embodiments, the seam is concealed when the seam is not visible to an observer when viewed from a distance of at least 7 ft. In some embodiments, the seam is concealed when the seam is not visible to an observer when viewed from a distance of at least 8 ft. In some embodiments, the seam is concealed when the seam is not visible to an observer when viewed from a distance of at least 9 ft. In some embodiments, the seam is concealed when the seam is not visible to an observer when viewed from a distance of at least 10 ft. In some embodiments, the seam is concealed when the seam is not visible to an observer when viewed from a distance of at least 11 ft. In some embodiments, the seam is concealed when the seam is not visible to an observer when viewed from a distance of at least 12 ft. In some embodiments, the seam is concealed when the seam is not visible to an observer when viewed from a distance of at least 13 ft. In some embodiments, the seam is concealed when the seam is not visible to an observer when viewed from a distance of at least 14 ft. In some embodiments, the seam is concealed when the seam is not visible to an observer when viewed from a distance of at least 15 ft. In some embodiments, the seam is concealed when the seam is not visible to an observer when viewed from a distance of at least 20 ft. In some embodiments, the seam is concealed when the seam is not visible to an observer when viewed from a distance of at least 25 ft. In some embodiments, the seam is concealed when the seam is not visible to an observer when viewed from a distance of at least 30 ft. In some embodiments, the seam is concealed when the seam is not visible to an observer when viewed from a distance of at least 35 ft. In some embodiments, the seam is concealed when the seam is not visible to an observer when viewed from a distance of at least 40 ft. In some embodiments, the seam is concealed when the seam is not visible to an observer when viewed from a distance of at least 50 ft.

In embodiments, one or more of the standing seam structures of the plurality of standing seam structures are oriented in a parallel or substantially parallel, spaced-apart configuration, e.g., the first standing seam structure 110 installed over the first seam and will be parallel or substantially parallel to the second standing seam structure 112 installed over the second seam. As used herein, the term "substantially parallel" refers to deviating less than 15° from a parallel alignment with respect to a spatial orientation of two objects. In some embodiments, the third standing seam structure 114 is parallel or substantially parallel to one or both of the first standing seam structure 110 and the second standing seam structure 112. In some embodiments, the first standing seam structure 110, the second standing seam structure 112, and the third standing seam structure 114 can be evenly spaced-apart and can be positioned on the roofing substrate so as to be parallel or substantially parallel to each other. In other embodiments, the plurality of standing seam structures can be oriented in a non-parallel configuration.

In some embodiments, the plurality of standing seam structures can extend along the roofing substrate in a vertical direction. For example, in some embodiments, the first standing seam structure 110, the second standing seam structure 112, and the third standing seam structure 114 extend from a top portion 118 of the roofing substrate 102 (e.g., from a ridge or hip portion of the roof to the eave of the roof) to a bottom portion 120 of the roofing substrate 102. In embodiments, the first standing seam structure 110, the second standing seam structure 112, and the other third standing seam structure 114 can extend across the roofing substrate 102 in a non-vertical direction. For example, in some embodiments, the first standing seam structure 110, the second standing seam structure 112, and the third standing seam structure 114 can extend in a horizontal direction. In some embodiments, the first standing seam structure 110, the second standing seam structure 112, and the third standing seam structure 114 extend from a first side of the roofing substrate 124 to a second side of the roofing substrate 124. In some embodiments, the first standing seam structure 110, the second standing seam structure 112, and the third standing seam structure 114 extend across the roofing substrate 124 in other non-vertical and/or non-horizontal direction, such as, for example and without limitation, diagonal directions, among others.

Given that in some embodiments the plurality of standing seam structures, or at least a portion thereof, is positioned over seams defined by overlapping edge portions of the plurality of roofing membranes, it will be appreciated that the plurality of seams and/or the plurality of roofing membranes can have a same or similar configuration as the plurality of standing seam structures.

Figure 2:
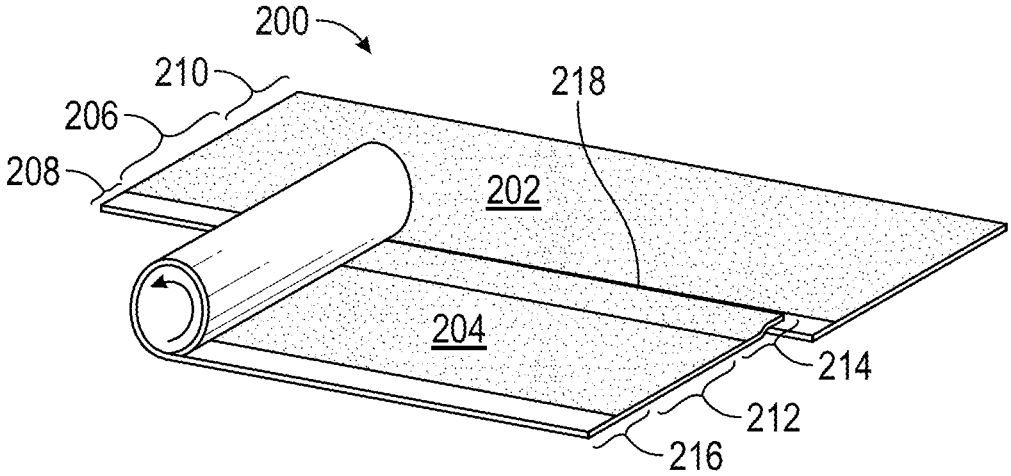
FIG. 2 is a schematic diagram showing a perspective view of a portion of a roofing structure, according to some embodiments.
Figure 3:
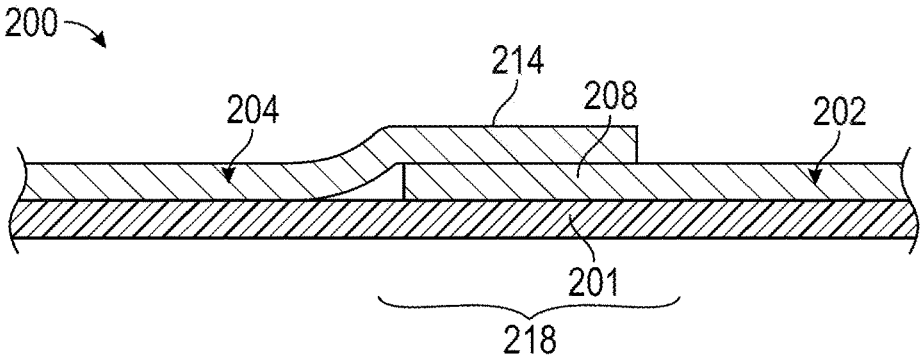
FIG. 3 is a schematic diagram showing a cross-section of the roofing structure, according to some embodiments.

FIG. 2 is a schematic diagram showing a perspective view of a portion of a roofing structure 200, according to some embodiments. FIG. 3 is a schematic diagram showing a cross-section of the roofing structure 200, according to some embodiments.

Referring to FIGS. 2-3, for purposes of illustration, the roofing structure 200 is shown as comprising a first roofing membrane 202 and a second roofing membrane 204. In some embodiments, the first roofing membrane 202 comprises a non-edge portion 206, a first edge portion 208, and a second edge portion 210 opposite the first edge portion 208. In some embodiments, the second roofing membrane 204 comprises a non-edge portion 212, a first edge portion 214, and a second edge portion 216 opposite the first edge portion 214. In some embodiments, the first edge portion 214 of the second roofing membrane 204 overlaps the first edge portion 208 of the first roofing membrane 202 so as to define a first seam 218. In the illustrated embodiments, the first edge portions 208, 214 and the second edge portions 210, 216 comprise selvage edges. In some embodiments, overlapping selvage edges result in a non-planar surface, relative to the non-edge portions 206, 212 of the first roofing membrane 202 and the second roofing membrane 204. In some embodiments, the non-planar surface is due to the combined thicknesses of the overlapping first edge portions 208, 214. In other embodiments, the first edge portions 208, 214 and the second edge portions 210, 216 comprise offset edges.

Figure 4:
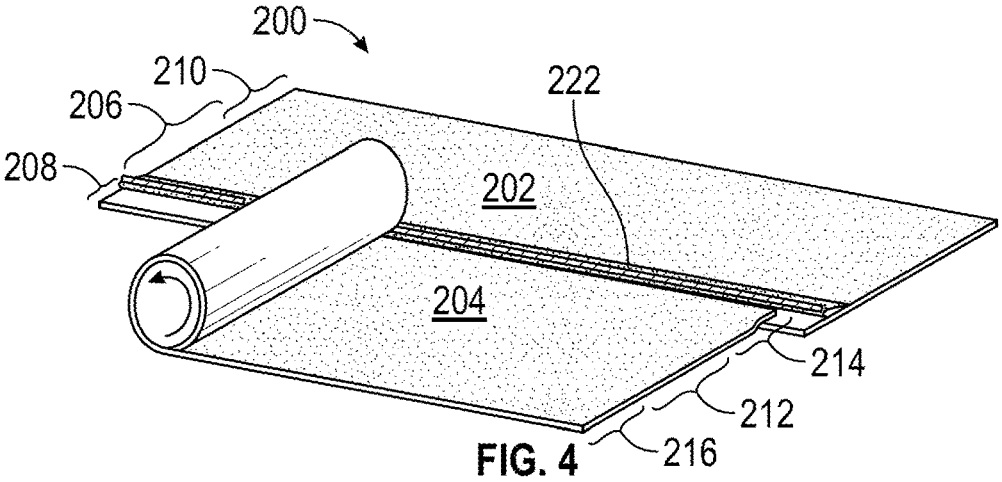
FIG. 4 is a schematic diagram showing a perspective view of a portion of the roofing structure, according to some embodiments.
Figure 5:
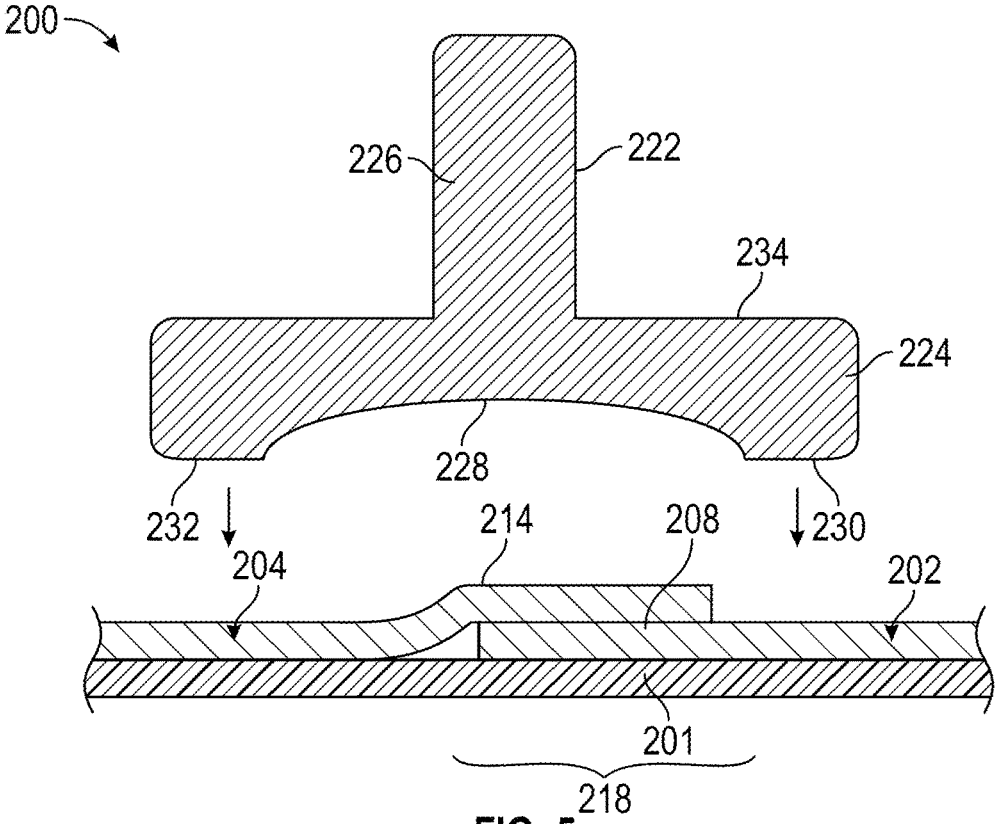
FIG. 5 is a schematic diagram showing a cross-section of the roofing structure, according to some embodiments.

FIG. 4 is a schematic diagram showing a perspective view of a portion of the roofing structure 200, according to some embodiments. FIG. 5 is a schematic diagram showing a cross-section of the roofing structure 200, according to some embodiments.

Referring to FIGS. 4-5, in embodiments, the roofing structure 200 comprises a standing seam structure 222 positioned over the first seam 218 so as to conceal the first seam 218 defined by overlapping selvage edges of first edge portions 208, 214. In some embodiments, the standing seam structure 222 comprises an inverted T-shaped standing seam structure. In some embodiments, the inverted T-shaped standing seam structure comprises a horizontal base 224 and a vertical member 226 coupled to or integral with the horizontal base 224. In some embodiments, the vertical member 226 is oriented perpendicular to the horizontal base 224. In some embodiments, the horizontal base 224 and the vertical member 226 are arranged to result in a cross-section having an inverted T-shaped configuration.

In some embodiments, the horizontal base 224 can further comprise a recessed cavity 228 formed in a bottom surface of the horizontal base 224. In some embodiments, the recessed cavity 228 can be configured such that the standing seam structure 222, when secured to the first roofing membrane 202 and the second roofing membrane 204, has a first bottom surface 230 in contact with the first roofing membrane 202 and a second bottom surface 232 in contact with the second roofing membrane 204. In embodiments, the recessed cavity 228 can be configured with an arched or raised configuration such that overlapped edge portions of the first and second roofing membranes are received within the recessed cavity; and a top surface 234 of the horizontal base 224 of the standing seam structure 222 will be oriented parallel or substantially parallel to the roofing substrate 201 when the standing seam structure is secured to the first roofing membrane 202 and the second roofing membrane 204. In some embodiments, both the horizontal base 224 and the vertical member 226 are elongated such that the standing seam structure 222 has a length that covers a specified portion of the first seam 218.

Figure 6:
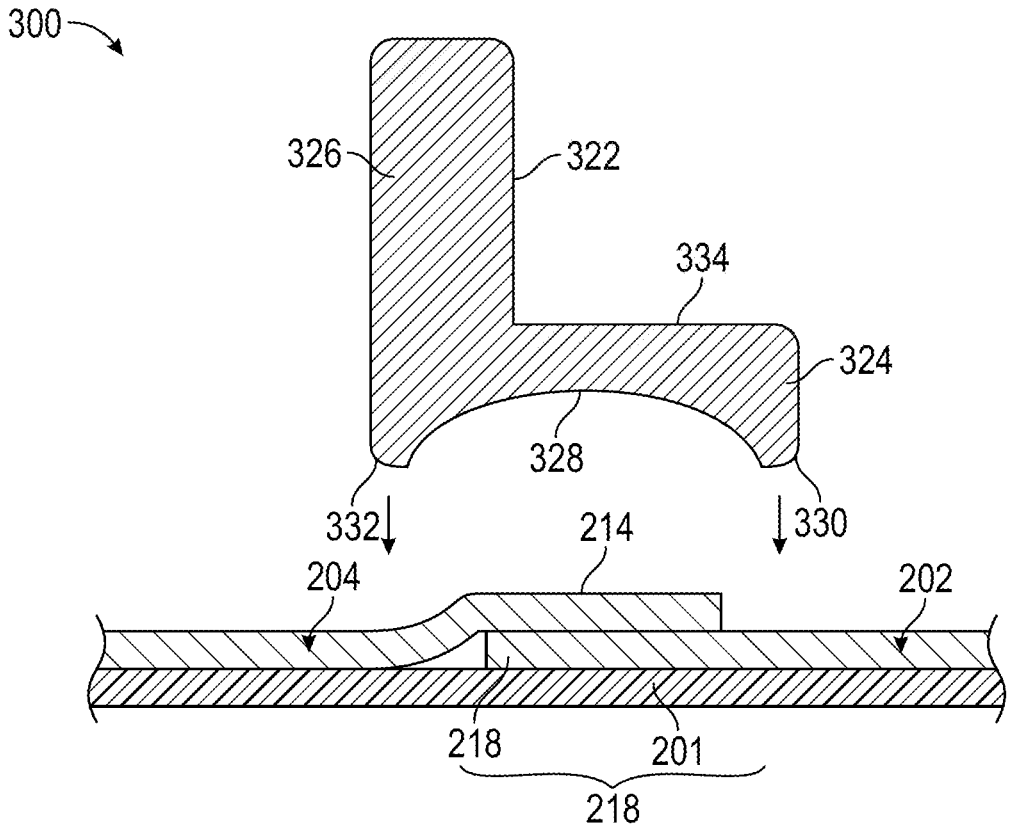
FIG. 6 is a schematic diagram showing a cross-section of a roofing structure, according to some embodiments.

FIG. 6 is a schematic diagram showing a cross-section of a roofing structure 300, according to other embodiments. As shown, the roofing structure 300 comprises the first roofing membrane 202, the second roofing membrane 204, and the roofing substrate from the roofing structure 200 discussed above. Accordingly, same or similar reference numbers are used.

Referring to FIG. 6, in embodiments, the roofing structure 300 comprises a standing seam structure 322 positioned over the first seam 218 so as to conceal the first seam 218 defined by overlapping selvage edges of first edge portions 208, 214. In some embodiments, the standing seam structure 322 comprises an L-shaped standing seam structure. In some embodiments, the L-shaped standing seam structure comprises a horizontal base 324 and a vertical member 326 coupled or integral to the horizontal base 324. In some embodiments, the vertical member 326 is oriented perpendicular to the horizontal base 324. In some embodiments, the horizontal base 324 and the vertical member 326 are arranged to result in a cross-section having an L-shaped configuration. In some embodiments, the horizontal base 324 comprises a recessed cavity 328 formed in a bottom surface of the horizontal base 324.

In embodiments, the recessed cavity 328 is configured such that the standing seam structure 322, when secured to the first roofing membrane 202 and the second roofing membrane 204, has a first bottom surface 330 in contact with the first roofing membrane 202 and a second bottom surface 332 in contact with the second roofing membrane 204. In embodiments, the recessed cavity 328 can be configured with an arched or raised configuration such that the overlapped edge portion of the first and second roofing membranes are received within the recessed cavity; and a top surface 334 of the horizontal base 324 of the standing seam structure 322 is parallel or substantially parallel to the roofing substrate 201 when the standing seam structure is secured to the first roofing membrane 202 and the second roofing membrane 204. In some embodiments, both the horizontal base 324 and the vertical member 326 are elongated such that the standing seam structure 322 has a length that covers a specified portion of the first seam 218.

Other standing seam structures, such as, for example, standing seam structures having cross-sectional shapes other than an L-shaped cross-section and/or a T-shaped cross-section may be used herein, such as, for example and without limitation, triangular cross-sections, rectangular cross-sections, square cross-sections, other letter-shaped cross-sections, and the like. The standing seam structures further can be configured to provide aesthetic characteristics or visual features to the roofing structure, in addition to concealing the seams between the roofing membranes.

Figure 7:
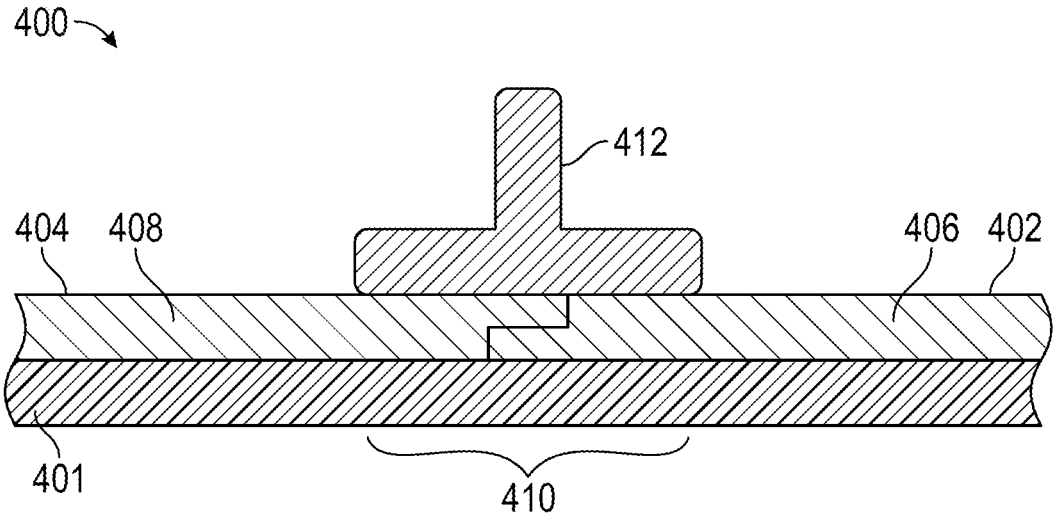
FIG. 7 is a schematic diagram showing a cross-section of a roofing structure, according to some embodiments.

FIG. 7 is a schematic diagram showing a cross-section of a roofing structure 400, according to some embodiments.

Referring to FIG. 7, in embodiments, the roofing structure 400 comprises overlapping offset edges defining a seam, with an inverted T-shaped standing seam structure positioned over the seam so as to conceal the seam. In some embodiments, the overlapping offset edges of the adjacent roofing membranes can comprise a step of an edge portion of a roofing membrane that is configured to be mated with an inverse step of an edge portion of another roofing membrane. For example, in some embodiments, a first edge portion 402 of a first roofing membrane comprises a step 406 configured to mate with an inverse step 408 of a first edge portion 404 of a second roofing membrane. In some embodiments, the mating first edge portions 402, 404 define a seam 410. In some embodiments, mating of the step 406 and the inverse step 408 results in a planar or substantially planar surface such that a recessed cavity is not required to orient and secure the standing seam structure 412 to the first roofing membrane and the second roofing membrane. Accordingly, in some embodiments, the standing seam structure 412 can have a planar bottom surface. As shown, the standing seam structure 412 is positioned over the mating first edge portions 402, 404 so as to conceal the seam 410.

Figure 8:
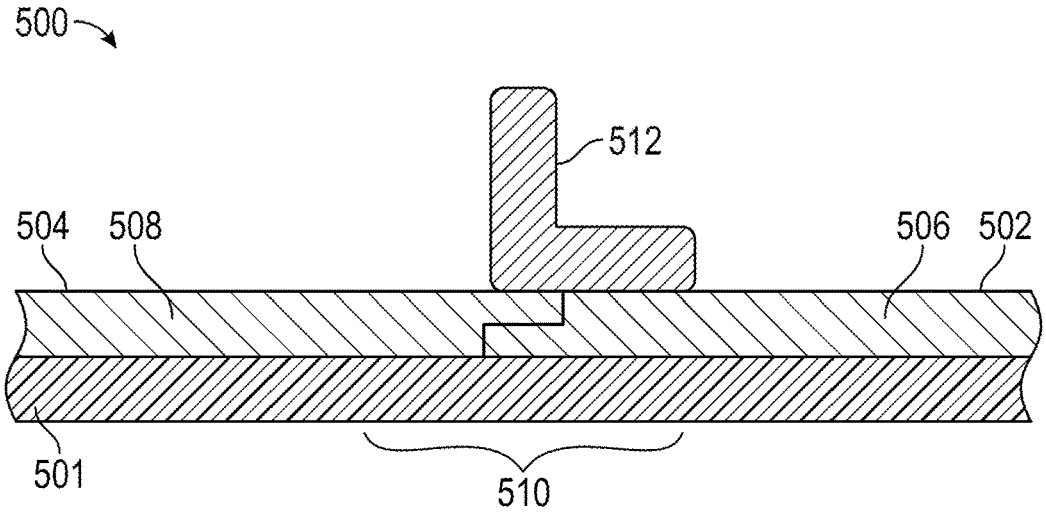
FIG. 8 is a schematic diagram showing a cross-section of a roofing structure, according to some embodiments.

FIG. 8 is a schematic diagram showing a cross-section of a roofing structure 500, according to some additional embodiments.

Referring to FIG. 8, in embodiments, the roofing structure 500 comprises overlapping offset edges defining a seam, with an L-shaped standing seam structure positioned over the seam so as to conceal the seam. For example, in some embodiments, a first edge portion 502 of a first roofing membrane comprises a step 506 configured to mate with an inverse step 508 of a first edge portion 504 of a second roofing membrane. In some embodiments, the mating first edge portions 502, 504 will define a seam 510. In some embodiments, mating of the step 506 and the inverse step 508 can result in a planar or substantially planar surface such that a recessed cavity is not required to orient and secure the standing seam structure 512 to the first roofing membrane and the second roofing membrane. Accordingly, in some embodiments, the standing seam structure 512 has a planar bottom surface. As shown, the standing seam structure 512 is positioned over the mating first edge portions 502, 504 so as to conceal the seam 510.

Figure 9:
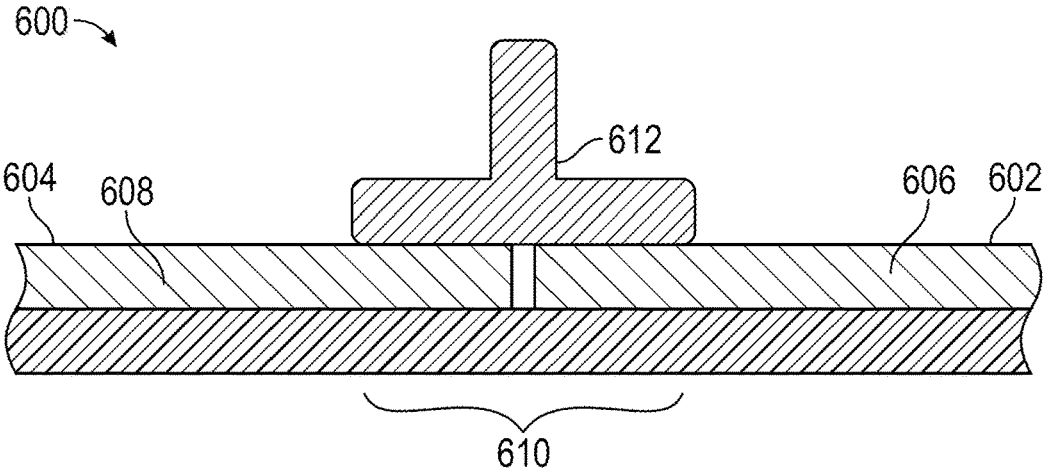
FIG. 9 is a schematic diagram showing a cross-section of a roofing structure, according to some embodiments.

FIG. 9 is a schematic diagram showing a cross-section of a roofing structure 600, according to some embodiments.

Referring to FIG. 9, in embodiments, the roofing structure 600 comprises adjacent abutting edge portions defining a seam therebetween, with a T-shaped standing seam structure positioned over the seam so as to conceal the seam. For example, in some embodiments, a first edge portion 602 of a first roofing membrane comprises an abutting edge 606 which abuts an adjacent abutting edge 608 of a first edge portion 604 of a second roofing membrane with the seam 610 therebetween. In some embodiments, the abutting edges 606, 608 may not be in contact with each other along the seam 610. As shown, the inverted T-shaped standing seam structure 612 is positioned over the abutting edges 606, 608 so as to conceal the seam 610.

Figure 10:
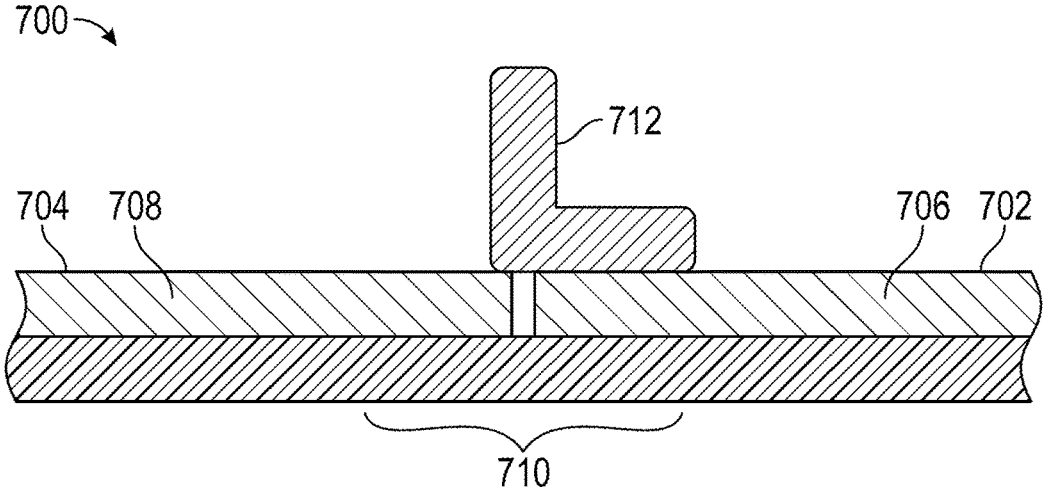
FIG. 10 is a schematic diagram showing a cross-section of a roofing structure, according to some embodiments.

FIG. 10 is a schematic diagram showing a cross-section of a roofing structure 700, according to some embodiments.

Referring to FIG. 10, in embodiments, the roofing structure 700 comprises abutting edges defining a seam 710, with an L-shaped standing seam structure positioned over the seam so as to conceal the seam. For example, in some embodiments, a first edge portion 702 of a first roofing membrane comprises an abutting edge 706 that abuts an adjacent abutting edge 708 of a first edge portion 704 of a second roofing membrane. In some embodiments, the abutting edges 706, 708 may not be in contact with each other along the seam 710. As shown, an L-shaped standing seam structure 712 can be positioned over the abutting edges 706, 708 so as to conceal the seam 710.

Figure 11:
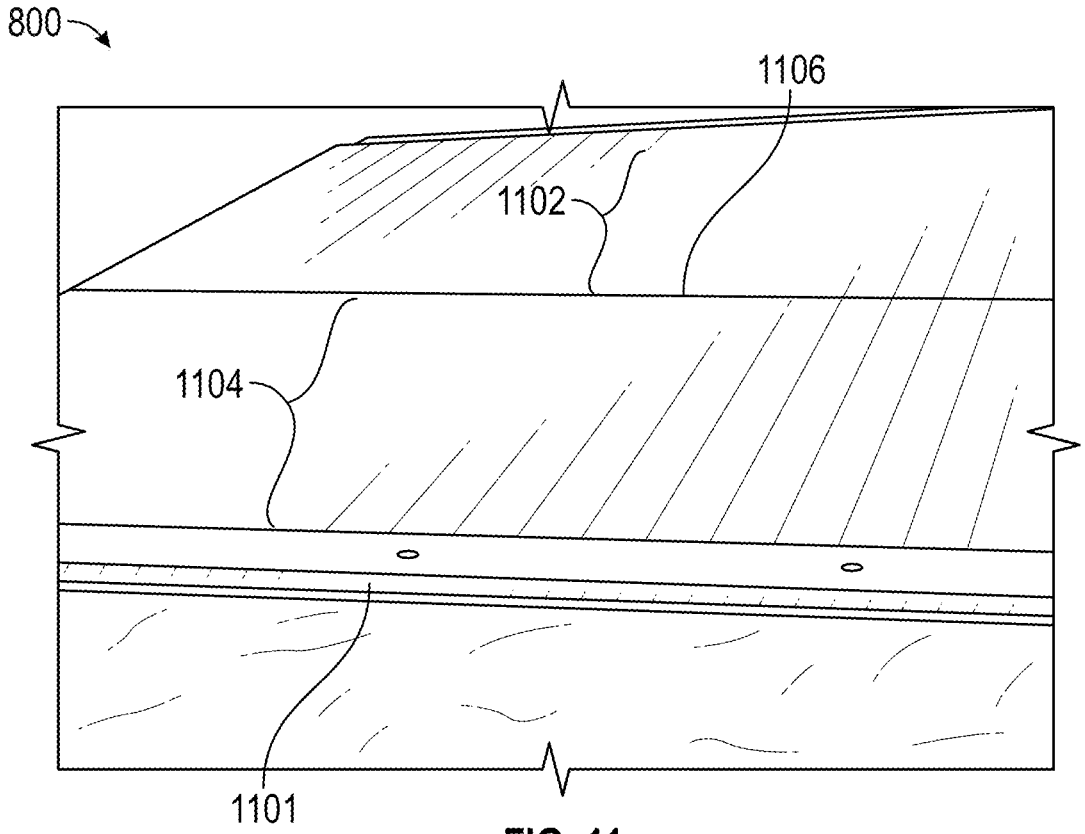
FIG. 11 is a photograph of a portion of a roofing structure, according to some embodiments.

FIG. 11 is a photograph of a portion of a roofing structure, according to some embodiments.

Referring to FIG. 11, the roofing structure 800 comprises a plurality of roofing membranes positioned on a roofing substrate, with each of the plurality of roofing membranes aesthetic features or characteristics. For example, the roofing membranes can have a pattern configured to be aligned with a pattern of other roofing membranes positioned on the substrate to form a continuous pattern so as to conceal the seam. For example, in some embodiments, the plurality of roofing membranes comprises at least one of a first roofing membrane 1102, a second roofing membrane 1104, or any combination thereof.

In some embodiments, the first roofing membrane 1102 comprises a first edge portion, and a second edge portion opposite the first edge portion. In some embodiments, the first edge portion and the second edge portion of the first roofing membrane 1102 comprise at least one of an abutting edge, an offset edge, or any combination thereof. In some embodiments, the first roofing membrane 1102 has a first pattern.

In some embodiments, the second roofing membrane 1104 comprises a first edge portion, and a second edge portion opposite the first edge portion. In some embodiments, the first edge portion and the second edge portion of the second roofing membrane 1104 comprise at least one of an abutting edge, an offset edge, or any combination thereof. In some embodiments, the second roofing membrane 1104 has a second pattern.

In some embodiments, the first roofing membrane 1102 is positioned adjacent to the second roofing membrane 1104 so as to define a seam 1106. In some embodiments, the first pattern of the first roofing membrane 1102 and the second pattern of the second roofing membrane 1104 are configured to be aligned on the roofing substrate 1101 to result in a continuous pattern sufficient to conceal the seam 1106.

In some embodiments, the first roofing membrane 1102 and the second roofing membrane 1104 do not comprise overlapping selvage edges. In some embodiments, the first roofing membrane 1102 and the second roofing membrane 1104 comprise overlapping offset edges defining the seam 1106. In some embodiments, the first roofing membrane 1102 and the second roofing membrane 1104 comprises abutting edges defining the seam 1106. In some embodiments, at least one of the first pattern, the second pattern, or any combination thereof comprises at least one of a random pattern, a grid pattern, a chevron pattern, a spiral pattern, a stripe pattern, or any combination thereof. In some embodiments, the first pattern is integral to the first roofing membrane 1102. In some embodiments, the second pattern is integral to the second roofing membrane 1104. In addition, the upper exposed surfaces can include aesthetic features, for example, having a selected color or an image.

Figure 12:
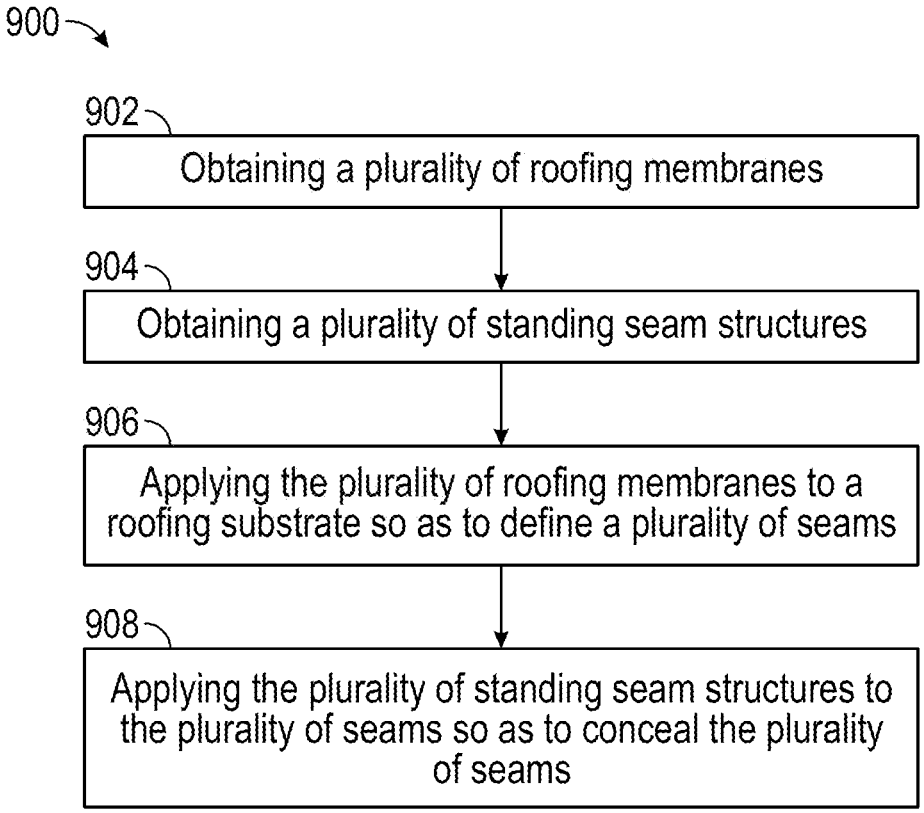
FIG. 12 is a flowchart of a method for installing a roofing structure, according to some embodiments.

FIG. 12 is a flowchart of a method for installing a roofing structure, according to some embodiments.

Referring to FIG. 12, the method 900 for installing a roofing structure comprises one or more of the following steps: obtaining a plurality of roofing membranes, as indicated at 902, obtaining a plurality of standing seam structures, as indicated at 904, applying the plurality of roofing membranes to a roofing substrate so as to define a plurality of seams, as indicated at 906, and applying the plurality of standing seam structures to the plurality of seams so as to conceal the plurality of seams, as indicated at 908.

In some embodiments, the method 900 comprises obtaining the plurality of roofing membranes (902). In some embodiments, the plurality of roofing membranes comprises any of the roofing membranes disclosed herein. For example, in some embodiments, the plurality of roofing membranes comprises at least one of a first roofing membrane, a second roofing membrane, a third roofing membrane, or any combination thereof.

In some embodiments, the first roofing membrane comprises a first edge portion and a second edge portion opposite the first edge portion. In some embodiments, the first edge portion and the second edge portion comprise at least one of a selvage edge, an offset edge, or any combination thereof. In some embodiments, the first edge portion and the second edge portion comprise an abutting edge. In some embodiments, the first edge portion and the second edge portion do not comprise an abutting edge.

In some embodiments, the second roofing membrane comprises a first edge portion and a second edge portion opposite the first edge portion. In some embodiments, the first edge portion and the second edge portion comprise at least one of a selvage edge, an offset edge, or any combination thereof. In some embodiments, the first edge portion and the second edge portion comprise an abutting edge. In some embodiments, the first edge portion and the second edge portion do not comprise an abutting edge.

In some embodiments, the third roofing membrane comprises a first edge portion and a second edge portion opposite the first edge portion. In some embodiments, the first edge portion and the second edge portion comprise at least one of a selvage edge, an offset edge, or any combination thereof. In some embodiments, the first edge portion and the second edge portion comprise an abutting edge. In some embodiments, the first edge portion and the second edge portion do not comprise an abutting edge.

While the first roofing membrane, the second roofing membrane, and the third roofing membrane are described herein, it will be appreciated that a greater number or lesser number of roofing membranes may be used herein without departing from this disclosure.

In some embodiments, the method 900 comprises obtaining a plurality of standing seam structures (904).

In some embodiments, the plurality of standing seam structures comprises any of the standing seam structures disclosed herein. For example, in some embodiments, the plurality of standing seam structures comprises at least one of a first standing seam structure, a second standing seam structure, or any combination thereof. In some embodiments, the first standing seam structure comprises at least one of an inverted T-shaped stranding seam structure, an L-shaped stranding seam structure, or any combination thereof. In some embodiments, the second standing seam structure comprises at least one of an inverted T-shaped stranding seam structure, an L-shaped stranding seam structure, or any combination thereof.

In some embodiments, the method 900 comprises applying the plurality of roofing membranes to a roofing substrate so as to define a plurality of seams (906).

In some embodiments, the applying comprises applying the first roofing membrane to a roofing substrate such that the first roofing membrane covers at least a portion of the roofing substrate. In some embodiments, the applying comprises applying the second roofing membrane to the roofing substrate such that the first edge portion of the second roofing membrane overlaps the first edge portion of the first roofing membrane so as to define a first seam. In some embodiments, the applying comprises applying the third roofing membrane to the roofing substrate such that the second edge portion of the third roofing membrane overlaps the second edge portion of the second roofing membrane so as to define a second seam.

In some embodiments, the applying comprises unrolling each of the plurality of roofing membranes onto the roofing substrate such that the edge portions of the plurality of roofing membranes define a seam. In some embodiments, the applying comprises securing the plurality of roofing membranes to the roofing substrate using at least one of an adhesive tape, an adhesive layer applied to a surface of a roofing membrane, an adhesive layer applied to a surface of the roofing substrate, a penetrating membrane, or any combination thereof. In some embodiments, the penetrating membrane comprises at least one of nails, screws, staples, or any combination thereof.

In some embodiments, the adhesive layer comprises a hot melt adhesive. In some embodiments, the adhesive layer comprises at least one of butyl hot melt adhesives, acrylic hot melt adhesives, silane-based adhesives, one or two-part polyurethane adhesives, water-dispersed adhesives, solvent-dispersed adhesives, sprayable rubber adhesive, adhesive tapes, or any combination thereof. In some embodiments, where an adhesive layer is applied to the membrane during the manufacturing process, the adhesive layer may be protected by a peelable layer that can be readily removed from the adhesive layer at the time of installation (e.g., a "peel-and-stick" adhesive layer). In some embodiments, where an adhesive layer is applied to the membrane at the time of installation, it may be applied using static charge, roller, brush, spray, adhesive spreader, or other technique.

In some embodiments, the method 900 comprises applying the plurality of standing seam structures to the plurality of seams so as to conceal the plurality of seams (908).

In some embodiments, the applying step 908 comprises applying the first standing seam structure to the first seam so as to conceal the first seam. In some embodiments, the applying 908 comprises applying the second standing seam structure to the second seam so as to conceal the second seam. In some embodiments, the first standing seam structure is parallel or substantially parallel to the third standing seam structure.

In some embodiments, the method 900 further comprises obtaining a third standing seam structure and applying the third standing seam structure to a non-edge portion of at least one of the first roofing membrane, the second roofing membrane, the third roofing membrane, or any combination thereof. In some embodiments, the third standing seam structure is parallel or substantially parallel to at least one of the first standing seam structure, the second standing seam structure, or any combination thereof.

The foregoing description generally illustrates and describes various embodiments of roofing structures and methods of installing roofing structures according to the principles of the present disclosure. It will, however, be understood by those skilled in the art that various changes and modifications can be made to the above-discussed construction of the present disclosure without departing from the spirit and scope of the disclosure as disclosed herein, and that it is intended that all matter contained in the above description or shown in the accompanying drawings shall be interpreted as being illustrative, and not to be taken in a limiting sense.

Furthermore, the scope of the present disclosure shall be construed to cover various modifications, combinations, additions, alterations, etc., above and to the above-described embodiments, which shall be considered to be within the scope of the present disclosure. Accordingly, various features and characteristics of the present disclosure as discussed herein may be selectively interchanged and applied to other illustrated and non-illustrated embodiments of the disclosure, and numerous variations, modifications, and additions further can be made thereto without departing from the spirit and scope of the present disclosure.

We claim:

1. A roofing structure comprising:

a roofing substrate;

a plurality of roofing membranes positioned along the roofing substrate, the plurality of roofing membranes comprising:

a first roofing membrane having a first edge portion and a second edge portion opposite the first edge portion; and a second roofing membrane comprising a first edge portion, and a second edge portion opposite the first edge portion;

wherein the first edge portion of the second roofing membrane is configured to overlie the first edge portion of the first roofing membrane in overlapping contact therewith so as to define a first seam between the first roofing membrane and the second roofing membrane;

wherein the first edge portion and the second edge portion of each of the roofing membranes comprise at least one of a selvage edge, an offset edge, or a combination thereof; and at least one standing seam structure positioned over the first seam, the at least one standing seam structure having a vertical member, and a horizontal member extending substantially perpendicular to the vertical member and configured to substantially conceal the first seam;

wherein the at least one standing seam structure comprises a monolithic structure with the horizontal member being integral with the vertical member; and wherein the at least one standing seam structure is secured to the first roofing membrane and the second roofing membrane with the horizontal member of the at least one standing seam structure extending over the first seam and in contact with the first roofing membrane and the second roofing membrane.

2. The roofing structure of claim 1, wherein the roofing substrate comprises a pitch of 4:12 to 12:12.

3. The roofing structure of claim 1, further comprising a third roofing membrane having a first edge portion, and a second edge portion opposite the first edge portion; wherein the second edge portion of the third roofing membrane is configured to overlap the second edge portion of the second roofing membrane so as to define a second seam between the second roofing membrane and the third roofing membrane.

4. The roofing structure of claim 3, wherein the second edge portion of the third roofing membrane comprises a selvage edge, an offset edge, or a combination thereof.

5. The roofing structure of claim 1, further comprising a third roofing membrane having a first edge portion, and a second edge portion opposite the first edge portion and configured to overlap the second edge portion of the second roofing membrane so as to define a second seam between the second roofing membrane and the third roofing membrane; and wherein the at least one standing seam structure comprises a first standing seam structure positioned over the first seam, a second standing seam structure positioned over the second seam, and a third standing seam structure positioned over a non-edge portion of at least one of the first roofing membrane, the second roofing membrane, or the third roofing membrane.

6. The roofing structure of claim 5, wherein the third standing seam structure is positioned substantially parallel to at least one of the first standing seam structure, the second standing seam structure, or both the first standing seam structure and the second standing seam structure.

7. The roofing structure of claim 1, wherein the plurality of roofing membranes comprises single layer membranes, multi-layer membranes, or a combination thereof.

8. The roofing structure of claim 1, wherein the at least one standing seam structure comprises an inverted T-shaped standing seam structure.

9. The roofing structure of claim 1, wherein the at least one standing seam structure comprises an L-shaped standing seam structure.

10. The roofing structure of claim 1, wherein the horizontal member of the at least one standing seam structure further comprises a recessed cavity formed in a bottom surface thereof; wherein the recessed cavity is configured to receive at least a portion of overlapped first edge portions of the first roofing membrane and the second roofing membrane.

11. A method, comprising:

obtaining a plurality of roofing membranes, each of the roofing membranes comprising a first edge portion and a second edge portion opposite the first edge portion;

wherein the first edge portion and the second edge portion of the roofing membranes comprise at least one of a selvage edge, an offset edge, or a combination thereof;

positioning a first roofing membrane on a roofing substrate;

positioning a second roofing membrane on the roofing substrate adjacent the first roofing membrane, with the first edge portion of the second roofing membrane in overlapped contact with the first edge portion of the first roofing membrane so as to define a seam therebetween; and positioning at least one standing seam structure over the seam defined between the first and second roofing membranes;

wherein the at least one standing seam structure is configured to substantially cover and conceal the seam;

wherein the at least one standing seam structure includes a vertical member and a horizontal member extending substantially perpendicular to the vertical member;

wherein the at least one standing seam structure comprises a monolithic structure with the horizontal member being integral with the vertical member; and securing the at least one standing seam structure to the first roofing membrane and the second roofing membrane with the horizontal member extending over the seam and in contact with the first roofing membrane and the second roofing membrane.

12. The method of claim 11, further comprising positioning a third roofing membrane on the roofing substrate adjacent the second roofing membrane, with a second edge portion of the third roofing membrane in overlapping contact with the second edge portion of the second roofing membrane so as to define a second seam between the second roofing membrane and the third roofing membrane.

13. The method of claim 12, further comprising positioning a second standing seam structure over the second seam so as to conceal the second seam.

14. The method of claim 13, further comprising positioning a third standing seam structure along a non-edge portion of at least one of the first roofing membrane, the second roofing membrane, or any combination thereof.

15. The method of claim 11, wherein positioning the first roofing membrane and positioning the second roofing membrane on the roofing substrate comprise applying the first and second roofing membranes across a slope of the roofing substrate, with the at least one standing seam structure extending in a substantially horizontal direction.

16. The method of claim 11, wherein positioning the first roofing membrane and positioning the seconding roofing membrane on the roofing substrate comprise applying the first and second roofing membranes along a slope of the roofing substrate extending from a ridge to an eave, with the at least one standing seam structure extending in a substantially vertical direction.

17. A roofing structure, comprising:

a roofing substrate;

a plurality of roofing membranes positioned on the roofing substrate, each of the roofing membranes comprising a sheet formed from a weather resistant material and having a first edge portion and a second edge portion;

wherein a first edge portion of a first roofing membrane is positioned in overlapping contact with an adjacent first edge portion of a second roofing membrane so as to define a seam between the first roofing membrane and the second roofing membrane;

wherein the first edge portion and the second edge portion of each of the roofing membranes comprise at least one of a selvage edge, an offset edge, or a combination thereof; and at least one standing seam structure positioned over the seam between the first roofing membrane and the second roofing membrane, the at least one standing seam structure comprising a vertical member and a horizontal member extending substantially perpendicular to the vertical member;

wherein the at least one standing seam structure is configured to seat over the seam between the first roofing membrane and the second roofing membrane sufficient to conceal the seam;

wherein the at least one standing seam structure comprises a monolithic structure with the horizontal member being integral with the vertical member; and wherein the at least one standing seam structure is secured to the first roofing membrane and the second roofing membrane with the horizontal member extending over the seam and in contact with the first roofing membrane and the second roofing membrane.

18. The roofing structure of claim 17, wherein the plurality of roofing membranes comprises single layer membranes, multi-layer membranes, or a combination thereof.

19. The roofing structure of claim 17, further comprising a third roofing membrane having a first edge portion, and a second edge portion opposite the first edge portion and configured to overlap the second edge portion of the second roofing membrane so as to define a second seam between the second roofing membrane and the third roofing membrane; a second standing seam structure positioned over the second seam; and a third standing seam structure positioned over a non-edge portion of at least one of the first roofing membrane, the second roofing membrane, or the third roofing membrane.

20. The roofing structure of claim 17, wherein the at least one standing seam structure comprises an inverted T-shaped standing seam structure.

21. The roofing structure of claim 17, wherein at least one standing seam structure comprises an inverted L-shaped standing seam structure.

22. The roofing structure of claim 17, wherein the horizontal member of the at least one standing seam structure further comprises a recessed cavity formed in a bottom surface thereof; wherein the recessed cavity is configured to receive at least a portion of overlapped first edge portions of the first roofing membrane and the second roofing membrane.

23. The roofing structure of claim 17, wherein the roofing substrate comprises at least one of a plywood substrate, a glass substrate, a cellulosic substrate, a polymeric substrate, a shingle, a scrim, a fabric, a glass mat, a fiberglass mat, an asphalt-coated fiberglass mat, an underlayment, a roofing membrane, a roof deck, a photovoltaic (PV) panel, a modified bitumen (MODBIT) material, a polyisocyanurate (ISO) foam board, a cover board, a gypsum board, metal panel, a concrete slab, a chimney, an asphalt material, or a combination thereof.

24. The roofing structure of claim 17, wherein the roofing membranes comprise at least one of a thermoplastic polyolefin (TPO), a polyvinyl chloride (PVC), an ethylene propylene diene monomer rubber (EPDM), poly(styrene-butadiene-styrene) (SBS), atactic polypropylene (APP), or a combination thereof.

* * * * *